US006692331B1

(12) United States Patent
Lin

(10) Patent No.: US 6,692,331 B1
(45) Date of Patent: Feb. 17, 2004

(54) VIBRATION MECHANISM FOR MOTION TOY

(76) Inventor: Cheng-Fu Lin, No. 97, Herng Shi Rd., San Shia Chen, Taipei Hsien (TW)

( * ) Notice: Subject to any disclaimer, the term of this patent is extended or adjusted under 35 U.S.C. 154(b) by 0 days.

(21) Appl. No.: 10/419,740

(22) Filed: Apr. 22, 2003

(51) Int. Cl.[7] ..... A63H 11/00

(52) U.S. Cl. ..... 446/353; 446/330; 40/431; 74/42; 74/54

(58) Field of Search ..... 446/219, 236, 446/298, 330, 352, 353, 354, 358, 359, 361, 366; 40/433, 434, 435, 444, 547, 427, 431; 74/25, 42, 47, 48, 54, 56, 57, 44, 55, 567, 569

(56) References Cited

U.S. PATENT DOCUMENTS 2,724,926 A * 11/1955 Fisher ..... 446/353
3,536,908 A * 10/1970 Oster ..... 40/431
3,766,376 A * 10/1973 Sadacca et al. ..... 40/433
5,121,646 A * 6/1992 Cho ..... 74/23
5,356,326 A * 10/1994 Ting ..... 446/175
6,450,855 B1 * 9/2002 Tang ..... 446/330

* cited by examiner

*Primary Examiner*—Derris H. Banks
*Assistant Examiner*—Bena B. Mie
(74) *Attorney, Agent, or Firm*—Bacon & Thomas, PLLC

(57) ABSTRACT

The present invention is to provide an improved vibration mechanism for a motion toy, which comprises a seat disposed on a top surface of a frame, two decorative member formed of a flexible bundle of plastic optical fibers and disposed in a pair of rollers being coupled together by gears in the seat, a drive link extended from one roller, a shaft extended from a drive device in the frame having an upper end coupled with one end of a horizontal rod, and a transmission rod having one end pivotably coupled to the other end of the horizontal rod and the other end pivotably coupled to an open end of the drive link so that, in response to a rotation of the drive device, the decorative members in the rollers vibrate rhythmically.

8 Claims, 5 Drawing Sheets

VIBRATION MECHANISM FOR MOTION TOY

FIELD OF THE INVENTION

The present invention relates to motion toys and more particularly to a vibration mechanism for motion toy with improved characteristics.

BACKGROUND OF THE INVENTION

A variety of early toys (e.g., toy dinosaurs, toy angels, toy animals, toy cartoons, etc.) were motionless. Hence, a consumer can only watch and/or fondle it. Nowadays, a wide variety of motion toys are produced by the manufacturers due to the progress of technology and increasing demand of consumers about quality. Conventionally, these motion toys are capable of moving, vibrating, rotating, and/or jumping. They are lovely and lively rather than a still toy. Thus, they are much attractive to the consumers as compared to the motionless toys.

Vibration mechanism for a decorative member (e.g., wing) of a typical motion toy angel is shown in FIG. 1. Following is a detailed description of principles of vibration of the wing. In a lower portion of the toy there are provided a cylindrical transmission cage 10 and an associated decorative member 11 disposed on the transmission cage 10. A seat 12 is provided on a top surface of the transmission cage 10 adjacent an edge thereof. A pair of upright cylindrical rollers 13 are provided in the seat 12. The decorative member 11 is formed of a flexible bundle of plastic optical fibers and is disposed in each of the rollers 13. The rollers 13 are coupled together by means of gears 131 so that a rotation of one roller 13 can cause the other roller 13 to rotate in an opposite direction. Further, a substantially half-looped drive link 14 is extended horizontally from a circumference of one of the rollers 13. An elongated channel 141 is substantially enclosed by the drive link 14. A motor 15 is provided in the transmission cage 10. A shaft 151 is extended upward from the motor 15. An upper end of the shaft 151 is projected above the transmission cage 10. A transmission rod 16 has one end coupled to the upper end of the shaft 151 and the other end formed as an upright cylinder 161. The cylinder 161 is disposed in and defined by the channel 141 of the drive link 14. In response to a rotation of the motor 15, the drive link 14 vibrates as the cylinder 161 of the transmission rod 16 rotates. Accordingly, one roller 13 rotates and thus the other roller 13 rotates too due to gear connection therebetween. In such a manner, the decorative members 11 in the rollers 13 vibrate rhythmically. As a result, a lively, lovely motion of the decorative members 11 is carried out.

However, the vibration mechanism of the well known toy angel suffered from several disadvantages. For example, a stroke of the cylinder 161 of the transmission rod 16 from one end of the channel 141 of the drive link 14 to the other end thereof is relatively long, resulting in a significant loss of output power of the motor 15. Further, a large portion of a color disc 17 is shaded by the drive link 14. As such, a user has a difficulty in observing a change of light at the color disc 17 while the motor 15 is rotating. Furthermore, the decorative member 11, formed of the flexible bundle of plastic optical fibers, has an outer diameter larger than an inner diameter of the roller 13, i.e., the decorative members are packed in the rollers 13. Unfortunately, both the decorative members 11 and the flexible bundle of plastic optical fibers tend to loosen in the rollers 13 after a period of time of use. As a result, a rotation of the rollers 13 cannot cause the same rotation of the decorative members 11. This can compromise the desired lovely, lively, and pleasing motion of the well known toy angel. Thus, it is desirable to provide a motion toy having an advantageous vibration mechanism for carrying out a lovely, lively motion thereof in order to overcome the above drawbacks of the prior art.

SUMMARY OF THE INVENTION

A primary object of the present invention is to provide an improved vibration mechanism for a motion toy. By utilizing this, the above drawbacks of the prior art can be overcome. These drawbacks are that a stroke of the cylinder of the transmission rod is too long in the channel of the drive link, a significant output power of the motor is lost, a user has a difficulty in observing a change of light at the color disc while the motor is rotating, and the decorative members tend to loosen in the rollers after a period of time of use.

One object of the present invention is to provide a vibration mechanism for a motion toy. The vibration mechanism is mounted in a lower portion of the motion toy and comprises a hollow, cylindrical frame, a seat disposed on a top surface of the frame adjacent an edge thereof, a pair of upright cylindrical rollers in the seat, two decorative member formed of a flexible bundle of plastic optical fibers and disposed in the rollers, the rollers being coupled together by means of gears so that a rotation of one roller can cause the other roller to rotate in an opposite direction, a drive link extended horizontally from a circumference of one roller, a drive device in the frame, a shaft extended upward from the drive device, the shaft having an upper end projected above the frame, a horizontal rod having one end coupled to the upper end of the shaft, and a transmission rod having one end pivotably coupled to the other end of the horizontal rod and the other end pivotably coupled to an open end of the drive link so that in response to a rotation of the drive device, the transmission rod rotates as the horizontal rod rotates, the drive link vibrates, one roller rotates as the other roller rotates, and the decorative members in the rollers vibrate rhythmically. As an end, a lively, lovely motion of the decorative members is carried out.

Another object of the present invention is to provide a plastic, hollow mounting cylinder in a lower part of each decorative member which is mounted in the mounting cylinder by applying low heat of joining. The mounting cylinder is adapted to snugly fit in the roller. A plurality of equally spaced apart longitudinal ribs are formed on an inner wall of each roller. The ribs are tapered from bottom to top. As such, the decorative members can be fastened in the rollers by tightly urging the ribs of the roller against the mounting cylinders when the decorative members are mounted in the rollers. Hence, a user can install the decorative members in the rollers in an angle. Once installed, the decorative members are fastened in the rollers. As an end, it is very hard to turn the decorative member to another angle.

The above and other objects, features and advantages of the present invention will become apparent from the following detailed description taken with the accompanying drawings.

DETAILED DESCRIPTION OF THE PREFERRED EMBODIMENTS

Figure 1:
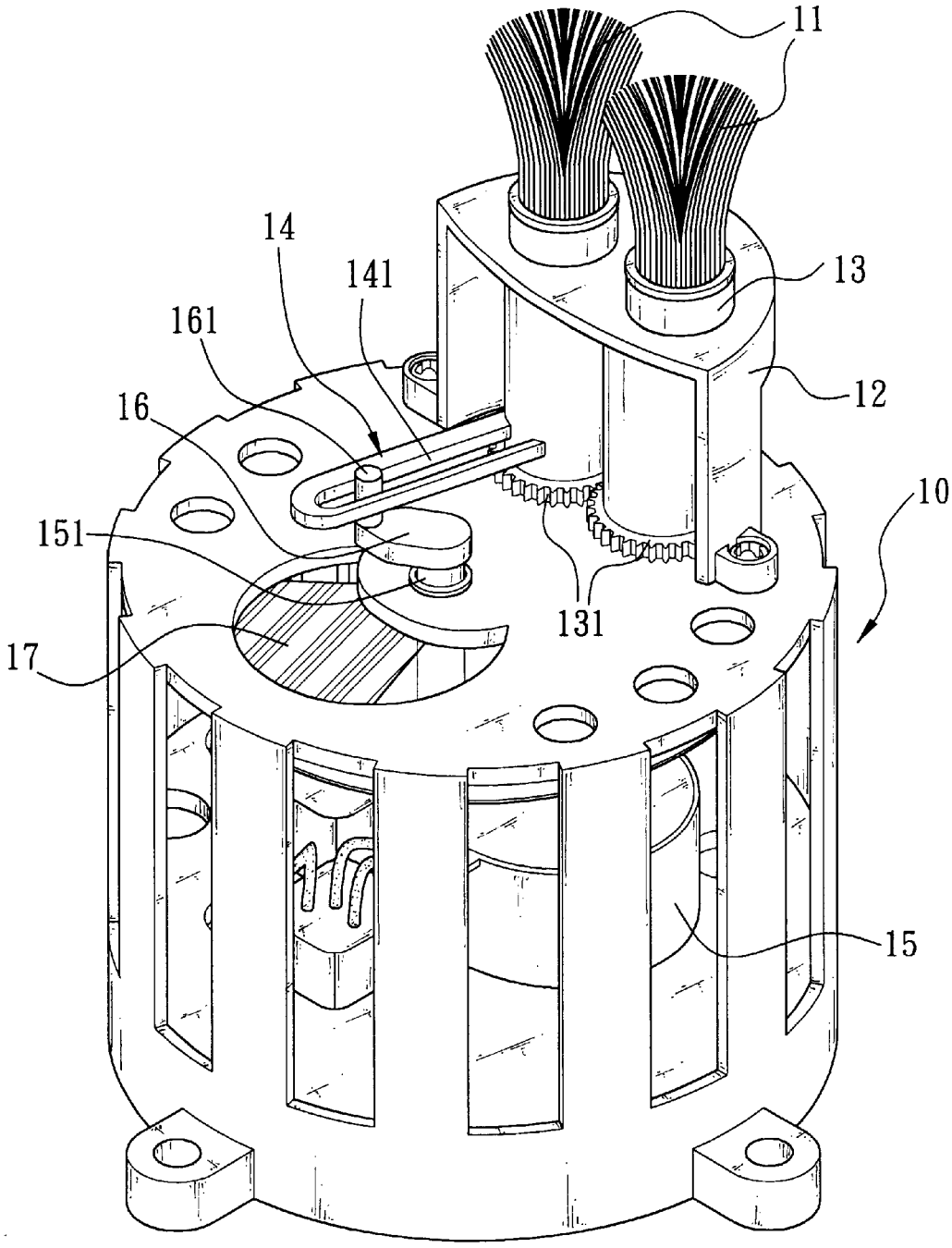
FIG. 1 (Prior Art)
FIG. 1 is a perspective view of a portion of a motion toy angel incorporating a conventional vibration mechanism.
Figure 2:
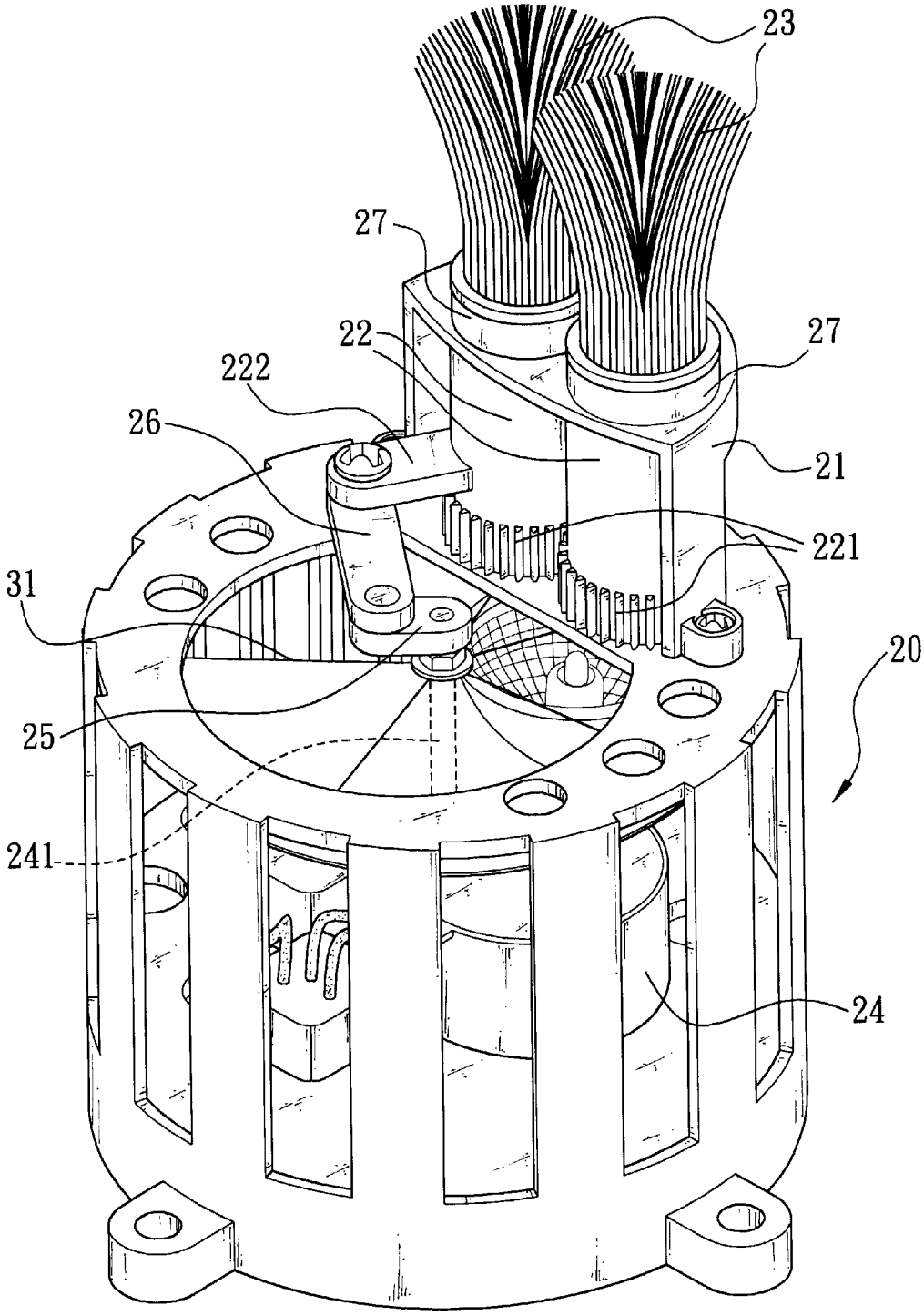
FIG. 2 is a perspective view of a portion of a motion toy angel incorporating a first preferred embodiment of vibration mechanism according to the invention.
Figure 3:
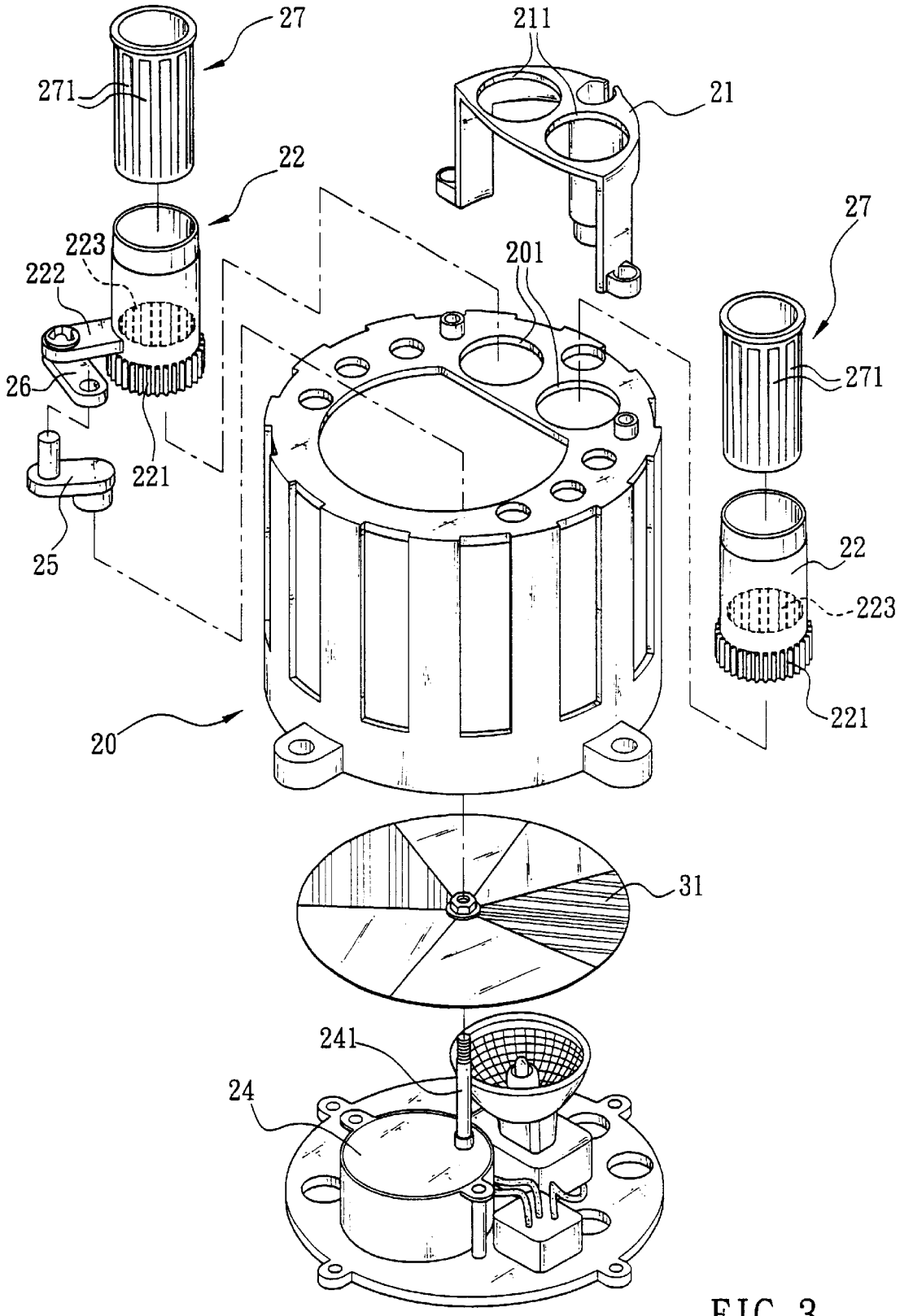
FIG. 3 is an exploded view of the vibration mechanism.

Referring to FIGS. 2 and 3, there is shown a first preferred embodiment of vibration mechanism mounted in a motion toy angel according to the invention. The mechanism is provided in a lower portion of the toy and comprises a cylindrical cage 20, a seat 21 disposed on a top surface of the cage 20 adjacent an edge thereof, a pair of upright cylindrical rollers 22 in the seat 21, and a decorative member (e.g., wing) 23 formed of a flexible bundle of plastic optical fibers and disposed in each of the rollers 22, the rollers 22 being coupled together by means of gears 221 so that a rotation of one roller 22 can cause the other roller 22 to rotate in an opposite direction. The mechanism further comprises a drive link 222 extended horizontally from a circumference of one of the rollers 22, a drive device (e.g., motor) 24 in the cage 20, a shaft 241 extended upward from the drive device 24, an upper end of the shaft 241 being projected above the cage 20, a horizontal rod 25 having one end coupled to the upper end of the shaft 241, and a transmission rod 26 having one end pivotably coupled to the other end of the horizontal rod 25 and the other end pivotably coupled to an open end of the drive link 222 of the roller 22.

Referring to FIGS. 2 and 3 again, in response to a rotation of the drive device 24, the transmission rod 26 rotates as the horizontal rod 25 rotates. Accordingly, the drive link 222 vibrates. Also, one roller 22 rotates and thus the other roller 22 rotates too due to gear connection therebetween. In such a manner, the decorative members 23 in the rollers 22 vibrate rhythmically. As a result, a lively, lovely motion of the decorative members 23 is carried out. At the same time, only a minimum output power of the drive device 24 is lost due to the advantageous linking mechanism of the transmission rod 26 and the drive link 222. Further, only a small portion of a color disc 31 is shaded by both the transmission rod 26 and the drive link 222 As such, a user can observe a large portion of change of light at the color disc 31 while the drive device 24 is rotating. As an end, the prior art drawbacks are substantially eliminated.

Figure 4:
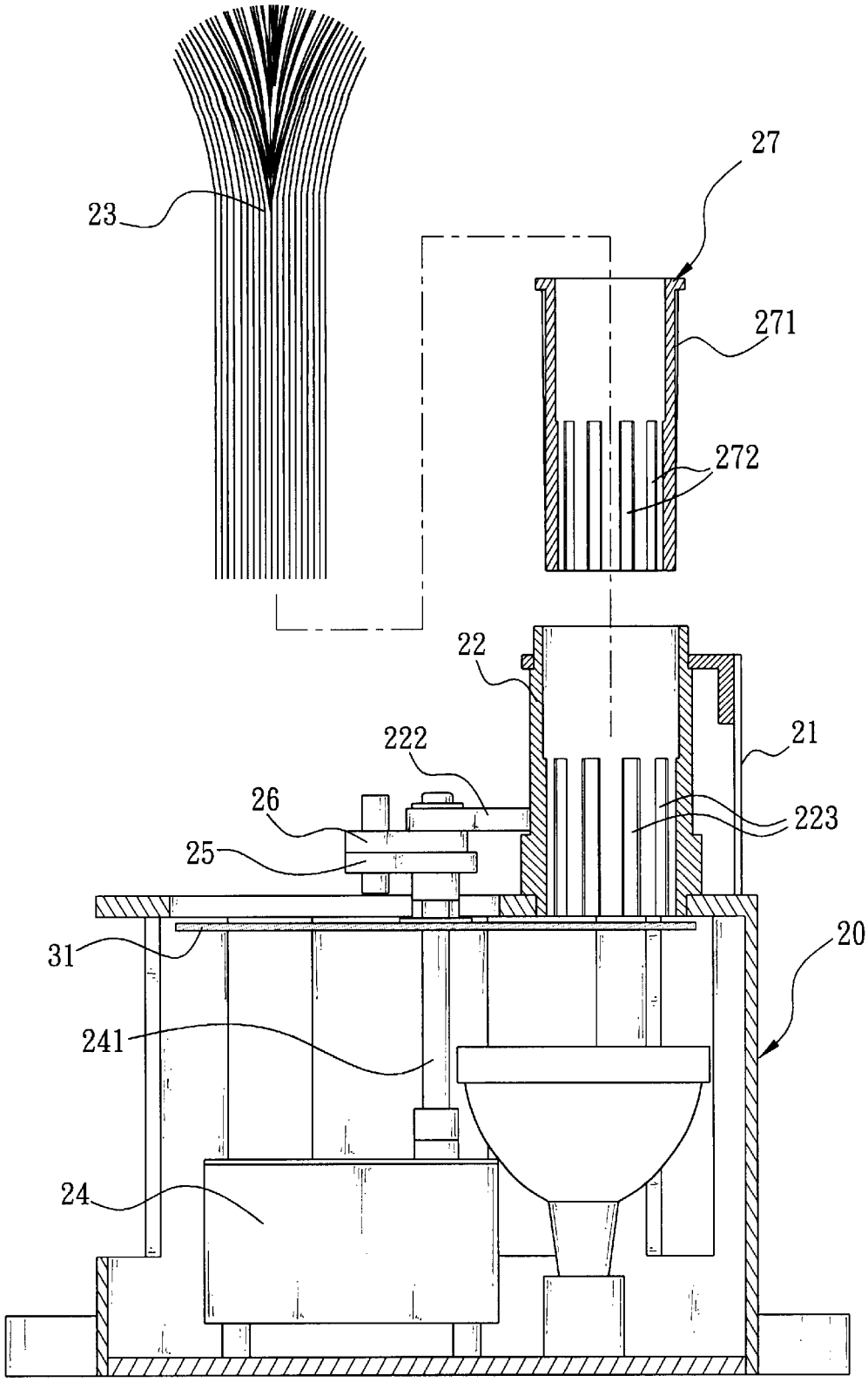
FIG. 4 is a cross-sectional view of the half assembled vibration mechanism.

Referring to FIG. 4 in conjunction with FIG. 3, a plastic, hollow mounting cylinder 27 is provided in a lower part of each decorative member 23. The decorative members 23 are mounted in the mounting cylinders 27 by applying low heat of joining. A size of the mounting cylinder 27 is adapted to snugly fit in the roller 22. A plurality of equally spaced apart longitudinal ribs 223 are formed on an inner wall of each roller 22. The ribs 223 are tapered from bottom to top. As such, the decorative members 23 can be fastened in the rollers 22 by tightly urging the ribs 223 of the roller 22 against the mounting cylinders 27 when the decorative members 23 are mounted in the rollers 22. In such a manner, a user can install the decorative members 23 in the rollers 22 in an angle. Once installed, the decorative members 23 are fastened in the rollers 22. As an end, it is very hard to turn the decorative member 23 to another angle.

Referring to FIGS. 3 and 4 again, in the invention a plurality of equally spaced apart longitudinal ribs 271 are formed on an outer wall of each mounting cylinder 27. The ribs 271 are mated with the ribs 223 of the roller 22. The ribs 271 are tapered from top to bottom. Hence, the decorative members 23 can be fastened in the rollers 22 by tightly urging the ribs 271 of the mounting cylinder 27 against a plurality of valleys each between two adjacent ribs 223 of the roller 22 when the decorative members 23 are mounted in the rollers 22. In such a manner, a user can install the decorative members 23 in the rollers 22 in an angle. Once installed, the decorative members 23 are fastened in the rollers 22. As an end, it is very hard to turn the decorative member 23 to another angle.

Referring to FIGS. 3 and 4 again, in the invention a plurality of equally spaced apart longitudinal second ribs 272 are formed on an inner wall of each mounting cylinder 27. The second ribs 272 are tapered from top to bottom. Hence, the decorative members 23 can be fastened in the mounting cylinders 27 by tightly urging the second ribs 272 of the mounting cylinder 27 against bottoms of the decorative members 23 when the bottoms of the decorative members 23 are mounted in the mounting cylinders 27. In such a manner, a user can install the decorative members 23 in the rollers 22 in an angle. Once installed, the decorative members 23 are fastened in the rollers 22. As an end, it is very hard to turn the decorative member 23 to another angle.

Referring to FIG. 3 again, in the invention the seat 21 is a shaped frame. The seat 21 can be secured to the top surface of the cage 20 by driving two fasteners (e.g., screws) through two side holes of the seat 21 into the cage 20. Two identical openings 211 are formed on the seat 21. Correspondingly, two identical openings 201 are formed on the top surface of the cage 20. As such, it is possible of inserting the rollers 22 into the openings 211 and 201. Further, the inserted rollers 22 are capable of rotating in the openings 211 and 201, i.e., rotate about the seat 21.

Figure 5:
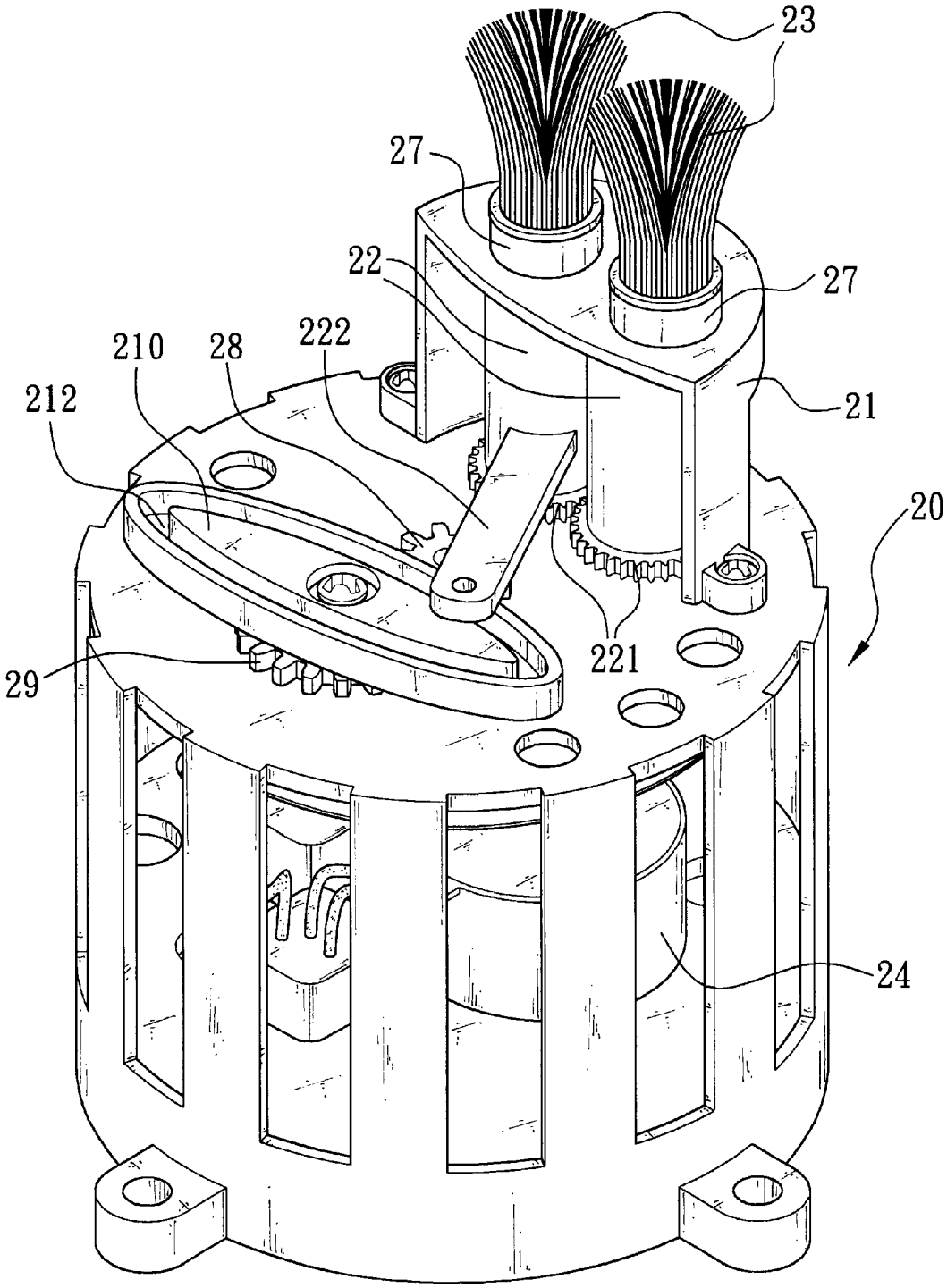
FIG. 5 is a perspective view of a portion of a motion toy angel incorporating a second preferred embodiment of vibration mechanism according to the invention.

Referring to FIG. 5, there is shown a second preferred embodiment of vibration mechanism mounted in a motion toy angel according to the invention. The characteristics of the second preferred embodiment are detailed below. The mechanism is provided in a lower portion of the toy and comprises a cylindrical cage 20, a seat 21 disposed on a top surface of the cage 20 adjacent an edge thereof, a pair of upright cylindrical rollers 22 in the seat 21, and a decorative member (e.g., wing) 23 formed of a flexible bundle of plastic optical fibers disposed in each of the rollers 22, the rollers 22 being coupled together by means of gears 221 so that a rotation of one roller 22 can cause the other roller 22 to rotate in an opposite direction. The mechanism further comprises a drive link 222 extended horizontally from a circumference of one of the rollers 22, a cylindrical rod (not numbered) extended downward from an open end of the drive link 222, a drive device (e.g., motor) 24 in the cage 20, a shaft (not numbered) extended upward from the drive device 24, an upper end of the shaft being projected above the cage 20, a first gear 28 provided around a top of the shaft, and a second gear 29 provided on the top of the cage 20 adjacent the first gear 28, the second gear 29 being meshed together with the first gear 28 so that a motion of the first gear 28 caused by a rotation of the drive device 24 is passed on to the second gear 29. The mechanism further comprises an oval disc 210 above the second gear 29, the disc 210 being rotated in synchronism with the second gear 29, and an oval groove 212 around a periphery of the disc 210, the cylindrical rod of the drive link 222 being defined in the groove 212 so that the cylindrical rod is able to slide along the groove 212 as the disc 210 rotates. At the same time, the drive link 222 vibrates for causing the rollers 22 to rotate the same while the cylindrical rod is sliding along the groove 212.

Referring to FIG. 5 again, in the invention in response to a rotation of the drive device 24, the second gear 29 rotates as the first gear 28 rotates. Accordingly, the disc 210 above the second gear 29 rotates in synchronism with the second gear 29. Also, the drive link 222 vibrates for causing the rollers 22 to rotate the same. In such a manner, the decorative members 23 in the rollers 22 vibrate rhythmically. As a result, a lively, lovely motion of the decorative members 23 is carried out.

Referring to FIG. 5 again, a plastic, hollow mounting cylinder 27 is provided in a lower part of each decorative member 23. The decorative members 23 are mounted in the mounting cylinders 27 by applying low heat of joining. A size of the mounting cylinder 27 is adapted to snugly fit in the roller 22. A plurality of equally spaced apart longitudinal ribs are formed on an inner wall of each roller 22. The ribs are tapered from bottom to top. As such, the decorative members 23 can be fastened in the rollers 22 by tightly urging the ribs of the roller 22 against the mounting cylinders 27 when the decorative members 23 are mounted in the rollers 22. In such a manner, a user can install the decorative members 23 in the rollers 22 in an angle. Once installed, the decorative members 23 are fastened in the rollers 22. As an end, it is very hard to turn the decorative member 23 to another angle.

Referring to FIG. 5 again, in the second embodiment of the invention a plurality of equally spaced apart longitudinal second ribs are formed on an outer wall of each mounting cylinder 27. The second ribs are mated with the ribs of the roller 22. The second ribs are tapered from top to bottom. Hence, the decorative members 23 can be fastened in the rollers 22 by tightly urging the second ribs of the mounting cylinder 27 against a plurality of valleys each between two adjacent ribs of the roller 22 when the decorative members 23 are mounted in the rollers 22. In such a manner, a user can install the decorative members 23 in the rollers 22 in an angle. Once installed, the decorative members 23 are fastened in the rollers 22. As an end, it is very hard to turn the decorative member 23 to another angle.

Referring to FIG. 5 again, in the second embodiment of the invention the seat 21 is a shaped frame. The seat 21 can be secured to the top surface of the cage 20 by driving two fasteners (e.g., screws) through two side holes of the seat 21 into the cage 20. Two identical first openings are formed on the seat 21. Correspondingly, two identical second openings are formed on the top surface of the cage 20. As such, it is possible of inserting the rollers 22 into the first and second openings. Further, the inserted rollers 22 are capable of rotating in the first and second openings, i.e., rotate about the seat 21.

While the invention has been described by means of specific embodiments, numerous modifications and variations could be made thereto by those skilled in the art without departing from the scope and spirit of the invention set forth in the claims.

What is claimed is:

1. A vibration mechanism for a motion toy, comprising:

a hollow, cylindrical frame including a seat on a top surface adjacent an edge thereof;

a pair of upright cylindrical rollers pivotably mounted in the seat, each of the rollers including a gear so that a rotation of one roller is capable of causing the other roller to rotate in an opposite direction and a plurality of equally spaced apart longitudinal first ribs on an inner wall thereof, the first ribs being tapered from bottom to top, and one of the rollers further including a drive link extended horizontally from a circumference thereof;

drive means disposed in the frame, the drive means including a shaft extended upward above the frame, a horizontal rod having one end coupled to an upper end of the shaft, and a transmission rod having one end pivotably coupled to the other end of the horizontal rod and the other end pivotably coupled to an open end of the drive link; and a decorative member formed of a flexible bundle of plastic optical fibers and disposed in each of the rollers, each of the decorative members being mounted in a plastic mounting cylinder by applying low heat of joining, the mounting cylinders being adapted to snugly fit in the rollers so that the decorative members are fastened in the rollers by tightly urging the first ribs of the roller against the mounting cylinders when the decorative members are mounted in the rollers;

wherein in response to a rotation of the drive means, the transmission rod rotates as the horizontal rod rotates, the drive link vibrates, one of the rollers rotates as the other roller rotates, and the decorative members vibrate in the rollers vibrate rhythmically.

2. The vibration mechanism of claim 1, wherein each of the mounting cylinders comprises a plurality of equally spaced apart longitudinal second ribs on an outer wall thereof, the second ribs being mated with the first ribs and being tapered from top to bottom so that the decorative members are fastened in the rollers by tightly urging the second ribs against a plurality of valleys each between two adjacent first ribs when the decorative members are mounted in the rollers.

3. The vibration mechanism of claim 1, wherein the seat is shaped to be secured to the top surface of the frame by driving a plurality of fasteners through the seat into the frame, the seat including a pair of first openings, and the frame further comprising a pair of second openings on the top surface thereof, the second openings corresponding the first openings so that the rollers are capable of inserting into the first and second openings and are capable of rotating about the seat.

4. The vibration mechanism of claim 1, wherein the drive means is a motor.

5. A vibration mechanism for a motion toy, comprising:

a hollow, cylindrical frame including a seat on a top surface adjacent an edge thereof;

a pair of upright cylindrical rollers pivotably mounted in the seat, each of the rollers including a gear so that a rotation of one roller is capable of causing the other roller to rotate in an opposite direction and a plurality of equally spaced apart longitudinal first ribs on an inner wall thereof, the first ribs being tapered from bottom to top, and one of the roller further including a drive link extended horizontally from a circumference thereof and a cylindrical rod extended downward from an open end of the drive link;

drive means disposed in the frame, the drive means including a shaft extended upward above the frame and a first gear around a top of the shaft;

a second gear disposed on the top surface of the frame adjacent the first gear, the second gear being meshed together with the first gear so that a motion of the first gear caused by a rotation of the drive means is passed on to the second gear;

an oval disc mounted above the second gear, the disc being rotated in synchronism with the second gear;

an oval groove disposed around a periphery of the disc, the groove being adapted to define the cylindrical rod therein so that the cylindrical rod slides along the groove as the disc rotates and the drive link vibrates for causing the rollers to rotate; and a decorative member formed of a flexible bundle of plastic optical fibers and disposed in each of the rollers, each of the decorative members being mounted in a plastic mounting cylinder by applying low heat of joining, the mounting cylinders being adapted to snugly fit in the rollers so that the decorative members are fastened in the rollers by tightly urging the first ribs of the roller against the mounting cylinders when the decorative members are mounted in the rollers;

wherein in response to a rotation of the drive means, the second gear rotates as the first gear rotates, the disc above the second gear rotates in synchronism with the second gear, the drive link vibrates for causing the rollers to rotate, and the decorative members vibrate in the rollers vibrate rhythmically.

6. The vibration mechanism of claim 5, wherein each of the mounting cylinders comprises a plurality of equally spaced apart longitudinal second ribs on an outer wall thereof, the second ribs being mated with the first ribs and being tapered from top to bottom so that the decorative members are fastened in the rollers by tightly urging the second ribs against a plurality of valleys each between two adjacent first ribs when the decorative members are mounted in the rollers.

7. The vibration mechanism of claim 5, wherein the seat is shaped to be secured to the top surface of the frame by driving a plurality of fasteners through the seat into the frame, the seat including a pair of first openings, and the frame further comprising a pair of second openings on the top surface thereof, the second openings corresponding the first openings so that the rollers are capable of inserting into the first and second openings and are capable of rotating about the seat.

8. The vibration mechanism of claim 5, wherein the drive means is a motor.

* * * * *